United States Patent [19]

Duckworth

[11] 4,068,628

[45] Jan. 17, 1978

[54] INTERNAL COMBUSTION ENGINE WITH DESIGNATED EXHAUST BURNING CYLINDERS

[76] Inventor: Charles England Duckworth, 1421 SE. 10th St., Deerfield Beach, Fla. 33441

[21] Appl. No.: 724,835

[22] Filed: Sept. 20, 1976

Related U.S. Application Data

[63] Continuation-in-part of Ser. No. 654,750, Feb. 3, 1976, abandoned, and Ser. No. 579,736, May 21, 1975, abandoned.

[51] Int. Cl.[2] ..... F02B 75/20; F02M 25/06

[52] U.S. Cl. ..... 123/59 EC; 123/119 A; 123/119 B; 60/620; 123/1 R

[58] Field of Search ..... 123/119 A, 119 B, 59 EC, 123/59 R, 1, 37; 60/620, 622

[56] References Cited

U.S. PATENT DOCUMENTS

| | | | |
|---|---|---|---|
| 1,152,386 | 8/1915 | Smith | 60/620 |
| 1,362,080 | 12/1920 | Chorlton | 123/59 EC |
| 1,603,256 | 10/1926 | Dunham | 60/622 |
| 1,904,070 | 4/1933 | Morgan | 60/620 |
| 2,113,602 | 4/1938 | Pratt | 123/59 EC |
| 3,426,524 | 2/1969 | Straub | 60/620 X |
| 3,727,594 | 4/1973 | Schultz | 123/59 EC |
| 3,776,207 | 12/1973 | Simko | 123/119 A |
| 3,779,013 | 12/1973 | Faber et al. | 60/278 |
| 3,805,752 | 4/1974 | Cataldo | 123/59 EC |
| 3,924,576 | 12/1975 | Siewert | 123/1 R |
| 3,941,113 | 3/1976 | Baguelin | 123/119 A |

FOREIGN PATENT DOCUMENTS

| | | | |
|---|---|---|---|
| 360,351 | 10/1922 | Germany | 123/59 EC |

*Primary Examiner*—Wendell E. Burns
*Attorney, Agent, or Firm*—Sughrue, Rothwell, Mion, Zinn and Macpeak

[57] ABSTRACT

A multi-cylinder, gasoline burning internal combustion engine is converted by modification of the intake and exhaust manifolds to an engine having designated exhaust burning cylinders which burn the exhaust gases that are expelled from the gasoline burning cylinders. The intake manifold is modified to isolate an even number of cylinders as the designated exhaust burning cylinders. Typically, two cylinders are chosen, although in some instances it is possible to designate four or even six cylinders, the number of designated exhaust burning cylinders not exceeding half the total number of cylinders in the engine. A pair of cylinders selected as exhaust burning cylinders have their pistons in the same relative positions and moving in the same relative directions but have spark ignition occurring at 360° with respect to each other. No modification is required to the ignition system of the engine. Both the designated exhaust burning cylinders and the gasoline burning cylinders exhaust into a common exhaust manifold system. The exhaust manifold system is modified so as to draw off the lighter exhaust gases to supply to the isolated intake manifold for the designated exhaust burning cylinders. Fresh air is added to the isolated intake manifold and to the exhaust manifold to combine with the exhaust gases to make conditions suitable for combustion in the designated exhaust burning cylinders. The vapors of the crankcase and the gasoline supply tank may be connected in series and supplied to the isolated intake manifold to provide an additional fuel source for the designated exhaust burning cylinders.

14 Claims, 5 Drawing Figures

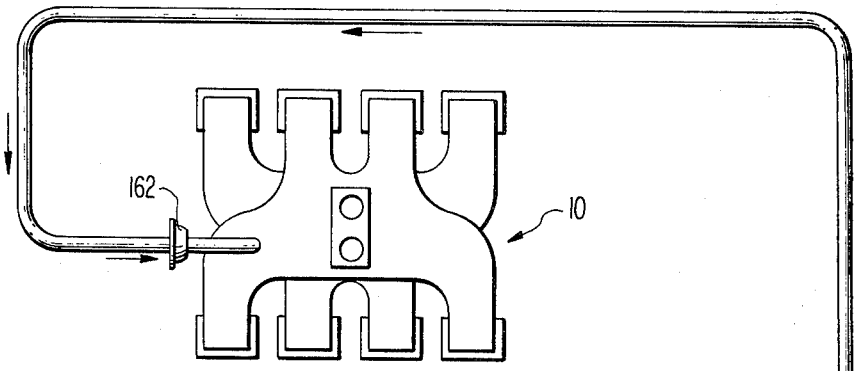
FIG. 5
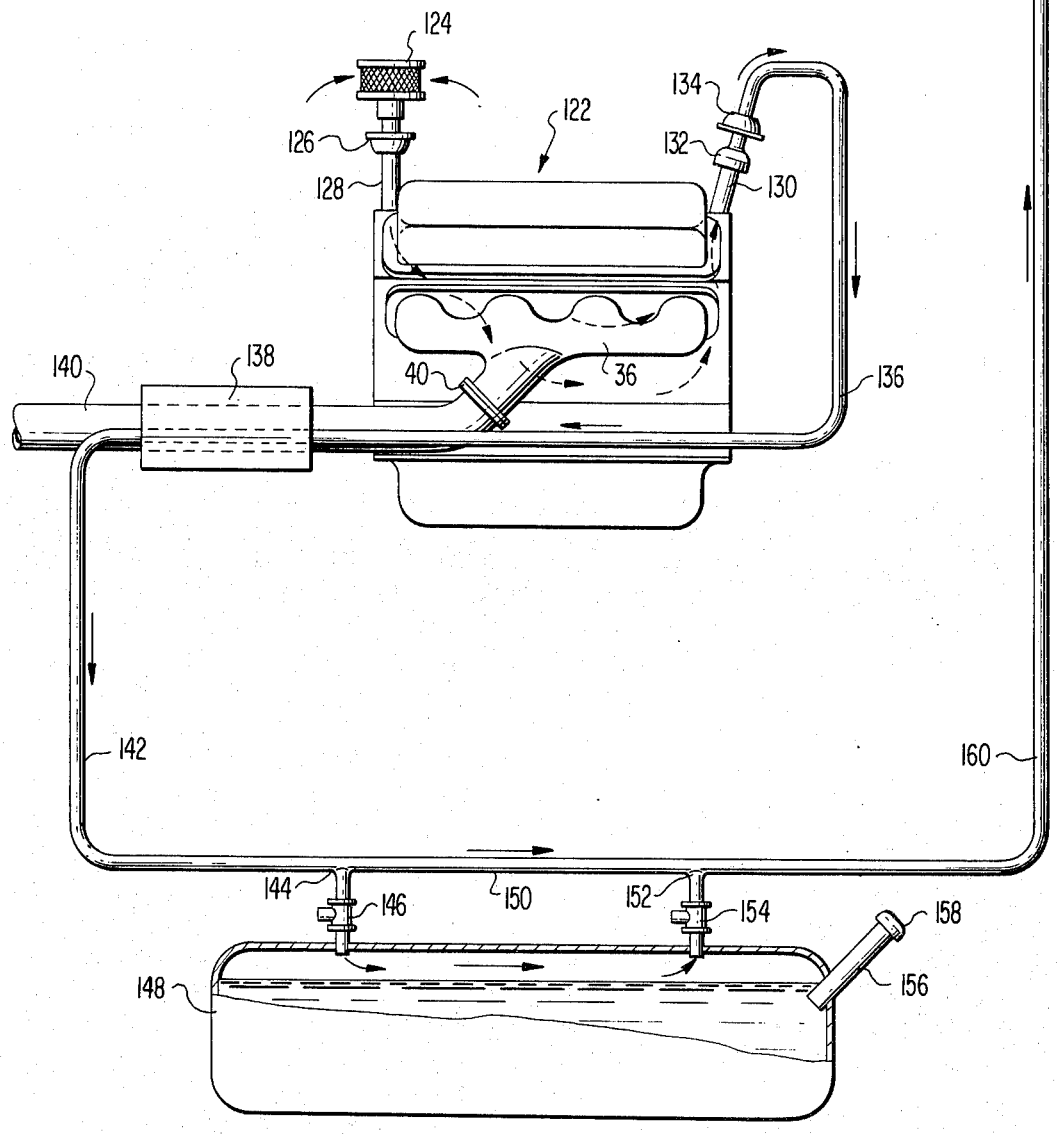

INTERNAL COMBUSTION ENGINE WITH DESIGNATED EXHAUST BURNING CYLINDERS

CROSS-REFERENCE TO RELATED APPLICATIONS

This application is a continuation in part application of patent application Ser. No. 579,736, filed May 21, 1975 abandoned, and patent application Ser. No. 654,750, filed Feb. 3, 1976 abandoned.

BACKGROUND OF THE INVENTION

The present invention generally relates to internal combustion engines, and more particularly to modified multicylinder, gasoline burning internal combustion engines wherein an even number of culinders are isolated for the purpose of burning the exhaust products of the engine.

It is well recognized that the combustion of fuel in gasoline burning combustion engines is incomplete resulting in the production of exhaust products rich in unburned hydrocarbons. These exhaust gases represent wasted energy and are a source of pollution. Over the years, varying degrees of interest have been shown in attempts to recover this wasted energy and make the engine more economical to operate and also to reduce as much as possible various exhaust products including unburned hydrocarbons and nitrogen oxides which are serious pollutants.

One approach is illustrated by the patent of Pratt, U.S. Pat. No. 2,113,602, issued Apr. 12, 1938. Pratt discloses an inline eight cylinder engine, the front four cylinders of which are gasoline burning cylinders and the rear four cylinders of which are exhaust burning cylinders. Pratt designates the gasoline burning cylinders as primary cylinders and the exhaust burning cylinders as secondary cylinders. All of the exhaust gases discharged by the primary cylinders, instead of passing into the atmosphere, are collected and treated to provide a new explosive mixture which is then passed to and burned in the secondary cylinders. Pratt requires an air pump or some other means of supplying pressurized air for mixing with the exhaust gases of the primary cylinders. A mixing box is located between the primary exhaust manifold and the secondary intake manifold, and this mixing box is provided with baffles and a flame screen which are necessary for both better mixing and preventing precombustion in the intake manifold of the secondary cylinders.

While Pratt discloses one approach to burning the exhaust products from a gasoline burning engine, his approach has several important drawbacks. The pressurized intake manifold for the secondary exhaust burning cylinders results in a high positive pressure in that intake manifold. This high positive pressure is not conducive to either good induction or correctly controlled fuel/air ratios in the secondary cylinders. Moreover, the arbitrary division of the engine into primary and secondary cylinders necessarily results in unacceptable torsional vibrations because of the large difference in operating efficiencies of the primary and secondary cylinders.

A more recent approach to the general idea of staged combustion in internal combustion engines to obtain low emissions of burned hydrocarbons, carbon monoxide and nitrogen oxides is disclosed in the patent to Siewert, U.S. Pat. No. 3,924,576 issued Dec. 9, 1975. In one embodiment, Siewert uses a V8 engine in which two cylinders of each bank are gasoline burning and the remaining two cylinders are exhaust burning. These first and second stage cylinders correspond to the primary and secondary cylinders in the Pratt system, and like the Pratt system, Siewert employs a pressurized system to supply exhaust from the first stage cylinders to the second stage cylinders. The second stage cylinders use compression ignition instead of spark ignition. The first stage cylinders are provided with a fuel-rich mixture which yields low residuals of nitrogen oxides but substantial unburned hydrocarbon exhaust products. These exhaust products are conditioned by injecting air to provide a slightly lean fuel mixture to the second stage cylinders.

The Siewert approach represents an improvement over the earlier ideas of Pratt, yet there are drawbacks of this method of staged combustion. For example, it is necessary for the first stage fuel ratio to be on the order of 10-1 in order to minimize the production of nitrogen oxides which are produced in some considerable quantity at the stoichiometric ratio of about 15-1. As a result, a two-stage V8 engine built according to the Siewert approach has a substantially lowered power output.

SUMMARY OF THE INVENTION

According to the present invention, an even number of cylinders in a multi-cylinder gasoline burning internal combustion engine are designated as exhaust burning cylinders. For example, in a V8 type internal combustion engine, two cylinders may be designated as the exhaust burning cylinders. The remaining six cylinders form a V6 type internal combustion engine. While this is the specific example which will be described as the preferred embodiment of the invention, it should be understood that four or even six cylinders could be selected as exhaust burning cylinders depending upon the type of engine in question. The number of exhaust burning cylinders should, however, not exceed one-half the total number of cylinders of the engine. A pair of cylinders designated as exhaust burning cylinders are selected so that their respective pistons are in the same relative positions and are traveling in the same relative directions at all times in the operation cycles. There is no modification to the spark ignition timing, and the spark ignition for any two selected exhaust burning cylinders will be 360° apart in a four-stroke cycle engine.

The intake manifold is modified to isolate the designated exhaust burning cylinders from the gasoline burning cylinders. However, in contrast to the approaches taken by Pratt and Siewert, a common exhaust manifold system is provided for the gasoline burning cylinders and the exhaust burning cylinders. This exhaust manifold system is modified to draw off the lighter conbustible exhaust products to supply to the isolated intake manifold for the designated exhaust burning cylinders. Fresh air is added to both the isolated intake manifold and the exhaust manifold system to combine with the exhaust gases to make conditions suitable for combustion in the designated exhaust burning cylinders.

Some of the features which characterize the invention may be enumerated as follows:

1. At least two cylinders are selected to be designated as exhaust burning cylinders in a multi-cylinder internal combustion engine. These two cylinders have their pistons in the same position relative to each other, and the motions of the pistons are in the same relative directions.

2. The intake manifold is altered to isolate the gasoline burning cylinders from the designated exhaust burning cylinders. In a specific example, the intake manifold for a V8 type internal combustion engine is not only altered to isolate the two designed exhaust burning cylinders from the gasoline burning cylinders, it is also modified so that the right carburetor bore supplies the three gasoline burning cylinders in the right bank of cylinders and the left carburetor bore supplies the three gasoline burning cylinders in the left bank of cylinders.

3. Both the gasoline burning cylinders and the exhaust burning cylinders exhaust into a common exhaust system. Means are provided for inducting the combustible gases of the common exhaust manifold system into the negative pressure isolated intake manifold when the exhaust burning cylinders are intaking in their respective intake cycle. A negative pressure is also established in the common exhaust manifold system when the exhaust burning cylinders are intaking in their respective cycles. The exhaust manifold is modified to enhance the collection of the lighter combustible gases of the common exhaust system to supply the isolated intake manifold of the designated exhaust burning cylinders. Fresh air in controlled amounts are added to these lighter exhaust gases to produce a suitable mixture for combustion by spark ignition in the designated exhaust burning cylinders.

4. The efficiency of the engine is increased by establishing a negative pressure in the common exhaust manifold system which promotes better breathing capabilities of the gasoline burning cylinders when the exhaust burning cylinders are intaking. Moreover, the temperatures of the gasoline burning cylinders are reduced by the removal of hot residual gases due to the suction produced by the exhaust burning cylinders on their intake cycle. Another factor contributing to the reduction of temperatures in the gasoline burning cylinders is due to the induction of fresh atmospheric air through an exhaust valve opening into the combustion chambers during the valve overlap period.

5. A further modification to the basic invention may be provided by venting the vapors of the crankcase and the gasoline supply tank in series and supplying these conbustible vapors to the isolated intake manifold as a supplementary fuel source. Accordingly, any accumulation of pressure in the crankcase or gasoline supply tank will be relieved into the isolated intake manifold by means of check valves.

BRIEF DESCRIPTION OF THE DRAWINGS

These and other features and advantages of the invention as well as various modifications and alterations will be more completely understood from the following description of a preferred embodiment given by way of non-limiting example, taken together with the accompanying drawings, in which:

FIG. 5 is a schematic representation of the system for venting vapors of the crankcase and fuel supply tank to the designated isolated exhaust burning cylinders in a V8 engine according to the invention.

DESCRIPTION OF THE PREFERRED EMBODIMENT

Figure 1:
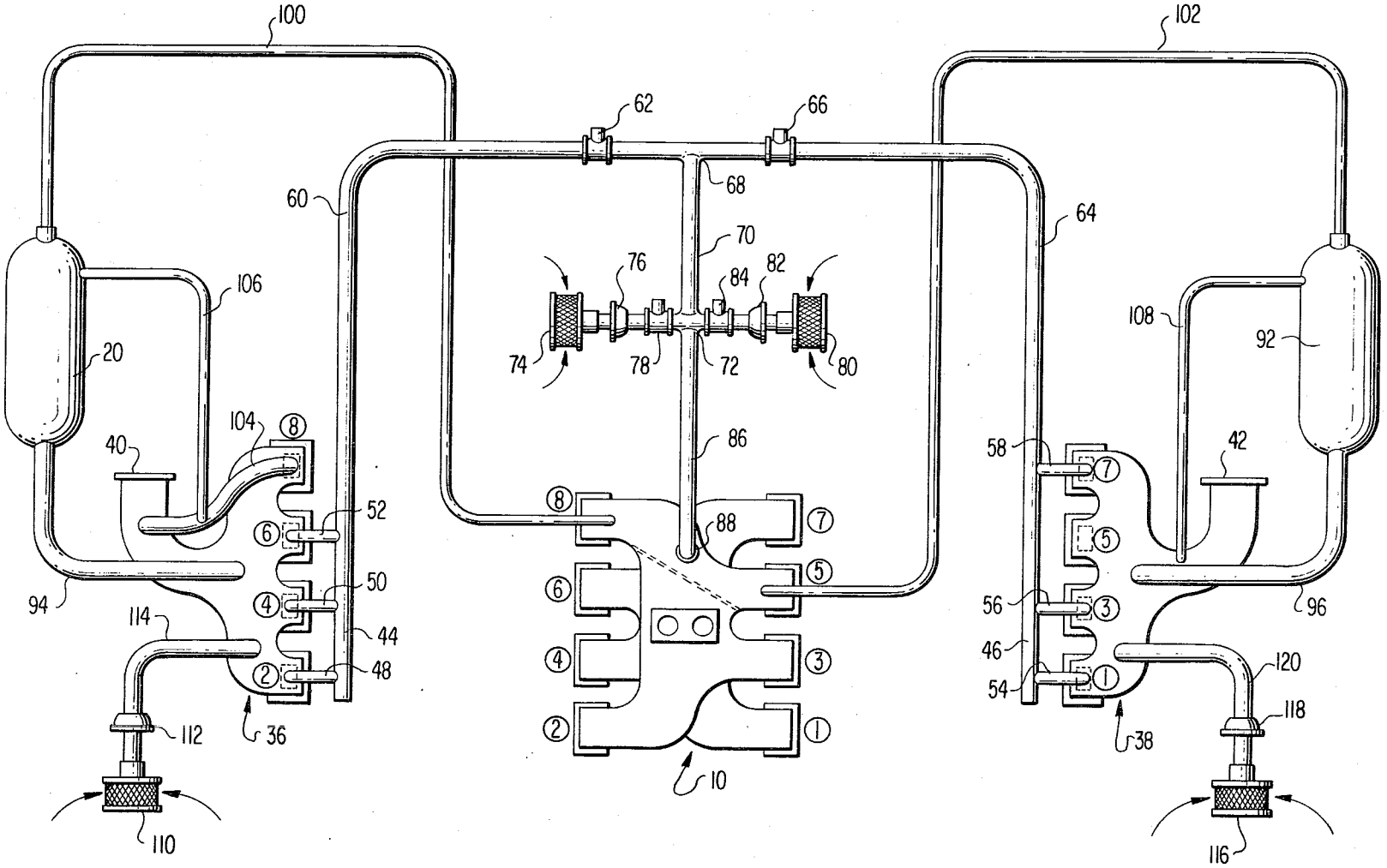
FIG. 1 is a schematic representation of the intake and exhaust manifolds and their interconnection for a V8 engine according to the basic invention.

The preferred embodiment described herein is directed to a convention V8 internal combustion engine of the type commonly used in automobiles and other vehicles. It will be understood, however, that the principles of the invention can be readily applied to other automotive internal combustion multicylinder engines having various configurations such as inline, V and flat or pancake configurations of any number of cylinders. An even number of cylinders are selected to be the designated exhaust burning cylinders. In the preferred embodiment to be described, two cylinders are selected with the remaining six cylinders forming a V6 gasoline burning engine. It will be understood, however, that more than two cylinders could be selected with the practical limitation that the number of cylinders selected as exhaust burning cylinders should be no more than half the number of total cylinders.

The criteria for selecting the two designated exhasut burning cyliners are that their pistons be in the same relative position and moving in the same direction at all points in the engine cycle. In a typical V8 automotive engine, the possible choices are the number 5 and number 8 cylinders, the number 4 and number 7 cylinders, the number 1 and number 6 cylinders, and the number 2 and number 3 cylinders. The firing order for this engine is 1, 8, 4, 3, 6, 5, 7 and 2, and this firing order remains the same as before alteration of the engine.

Referring now to FIG. 1 of the drawings, the intake manifold 10 for a V8 internal combustion engine is shown in plan view with the intake ports numbered according to the corresponding cylinder of the engine. The intake manifold 10 is designed to accept a two-barrel carburetor of conventional design, but it is possible to use an intake manifold adapted to receive a four-barrel carburetor. In the specific embodiment illustrated, the cylinders selected to be the designated exhaust burning cylinders are cylinders 5 and 8. The dotted line on the intake manifold indicates that these two cylinders are joined in common with an isolated intake manifold. Before modification, the intake manifold 10 is designed so that the left carburetor barrel supplies cylinders 1, 4, 6 and 7, and the right curburetor barrel supplies cylinders 2, 3, 5 and 8. Besides isolating the intake manifold for cylinders 5 and 8, the intake manifold is further modified so that the left barrel supplies cylinders 1, 3 and 7, and the right barrel of the carburetor supplies cylinders 2, 4 and 6.

Figure 2:
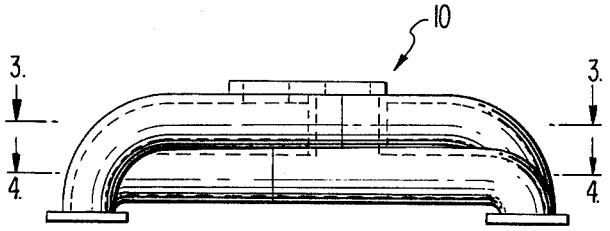
FIG. 2 is a front elevation drawing of the intake manifold for a V8 engine.
Figure 3:
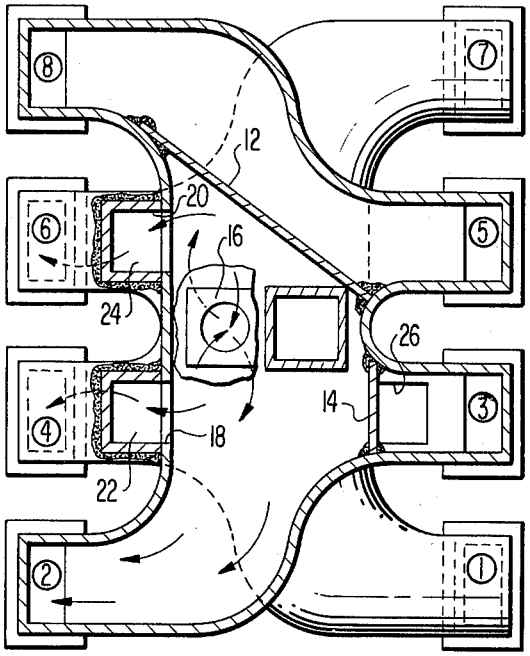
FIG. 3 is a plan sectional view of the intake manifold taken along section line 3—3 in FIG. 2 and showing modifications to the intake manifold according to the preferred embodiment.
Figure 4:
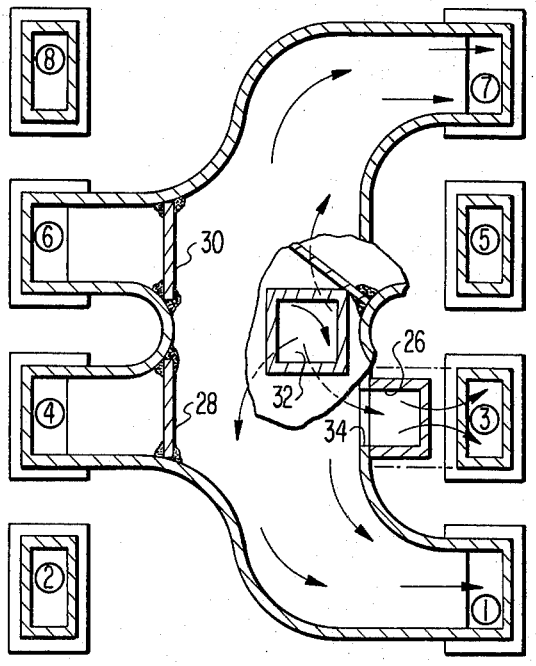
FIG. 4 is a plan sectional view of the intake manifold taken along section line 4—4 in FIG. 2 showing further modifications to the intake manifold according to the preferred embodiment of the invention.

The modifications to the intake manifold will be described in more detail with reference to FIGS. 2, 3 and 4. FIG. 2 is a front elevation view of the intake manifold which illustrates the two-level design of the manifold with the upper level of the manifold communicating with the right barrel of the carburetor supplying cylinders 2, 3, 5 and 8 and the lower level of the manifold communicating with the left barrel of the carburetor supplying cylinders 1, 4, 6 and 7. FIGS. 3 and 4 are plan cross-sectional views taken along lines 3—3 and 4—4, respectively, in FIG. 2.

The first modification to the intake manifold is to isolate the number 5 and number 8 cylinders. This is accomplished by welding a plate 12 diagonally across the interior of the upper level of the manifold as illustrated in FIG. 3. Next, the common communication between intake ports 2 and 3 are blocked by welding a plate 14 in the upper level of the intake manifold at the opening to the port for the number 3 cylinder. At this point, the port 16 for the right barrel of the carburetor, represented by the broken out portion of the section drawing, communicates only with the intake port for the number 2 cylinder. Holes are next cut into the side wall of the upper level of the intake manifold at 18 and 20 adjacent to the pipes for the number 4 and number 6 cylinders in the lower level of the intake manifold. Corresponding holes are cut at 22 and 24 in the tops of the pipes of the lower level of the intake manifold which supply the number 4 and number 6 cylinders. Steel plates (not shown) are then welded to form a passage between the holes at 18 and 22 and between the holes at 20 and 24. For example, two triangular shaped pieces of steel plate are welded to either side of the hole cut in the side wall of the upper level of the intake manifold at 18 and to either side of the hole cut into the top of the pipe at 22 in the lower level of the intake manifold, and then a rectangular shaped steel plate is welded between the upper and lower levels of the intake manifold and to the two triangular shaped steel plates previously welded in place. When this process is completed, the right barrel of the carburetor will supply cylinders 2, 4 and 6. One additional modification to the upper level of the intake manifold is required. The number 3 cylinder has been isolated from the number 2 cylinder by the steel plate 14. It is therefore necessary to cut a hole at 26 in the bottom of the pipe which supplies the number 3 cylinder.

Turning now to FIG. 4, the modifications to the lower level of the intake manifold are illustrated. Prior to modification, the left barrel of the carburetor supplied via the lower level of the intake manifold, the numbers 1, 4, 6 and 7 cylinders. After modification of the upper level of the intake manifold, it is now necessary to isolate the number 4 and number 6 cylinders from the number 1 and number 7 cylinders. This is accomplished by welding steel plates 28 and 30, respectively, over the inlets to the pipes leading to the number 4 and number 6 cylinders. It will be recalled that the left barrel of the carburetor is to supply via port 32 illustrated in the broken out section the numbers 1, 3 and 7 cylinders of the engine. For this purpose, a hole is cut into the side wall at 34 of the lower level of the intake manifold adjacent to the pipe which supplies the number 3 cylinder. This hole cooperates with the hole cut at 26 in the bottom of the pipe which supplies the number 3 cylinder in the same manner that the holes at 18 and 22 and the holes at 20 and 24 cooperate. More specifically, two triangular shaped pieces of steel plate are welded to either side of the hole at 34 to the side wall of the lower level of the intake manifold and also to either side of the hole at 26 to the bottom of the pipe which supplies the number 3 cylinder. A rectangular piece of steel plate is then welded between the lower level of the intake manifold and the pipe which supplies the number 3 cylinder and to each of the two triangular pieces of steel plate previously welded in place on either side of the holes at 34 and 26.

Thus, as modified the intake manifold is characterized by the following features: (1) the intake manifold for the number 5 and number 8 cylinders is isolated from both carburetor ports and from the gasoline burning cylinders of the engine. (2) The right carburetor barrel supplies the numbers 2, 4 and 6 cylinders which are located in common in the right bank of the engine. (3) The left carburetor barrel supplies the numbers 1, 3 and 7 cylinders which are located in common in the left bank of the engine.

It will, of course, be appreciated that a special manifold could be cast which would provide the same features of the modified manifold as illustrated in FIGS. 3 and 4. For purposes of constructing a prototype of the preferred embodiment of the invention, however, it was cheaper to modify the standard intake manifold as described, and although the various modifications do not necessarily result in an optimum design, the altered intake manifold more than adequately demonstrates the principles of the invention.

Considering for a moment only the gasoline burning cylinders, these cylinders may be considered as forming a V6 engine having the firing order of 1, 4, 3, 6, 7 and 2. This arrangement results in a smoothly running V6 gasoline burning engine. Note that this configuration and firing order is accomplished only through a modification or alteration of the intake manifold with no modification of the firing order of the ignitiion system of the engine.

Returning now to FIG. 1 of the drawings, the exhaust manifold for the right bank of the engine is shown at 36, while the exhaust manifold for the left bank of the engine is shown at 38. More specifically, exhaust manifold 36 connects in common the exhaust ports of the numbers 2, 4, 6 and 8 cylinders, and the exhaust manifold 38 connects in common the exhaust ports of the numbers 1, 3, 5 and 7 cylinders. As is conventional, the outlets 40 and 42 of the exhaust manifolds 36 and 38, respectively, are connected in common by a Y connection (not shown). This connection is connected to an exhaust pipe, muffler and tailpipe combination to vent the exhaust gases collected by the exhaust manifolds 36 and 38 to the atmosphere.

While the exhaust manifolds 36 and 38 collect the exhaust gases from all of the cylinders in common, several modifications are made to the exhaust manifolds to collect the combustible gases for supply to the isolated intake manifold for the number 5 and number 8 designated exhaust burning cylinders and to relieve pressures in the exhaust manifold for purposes of creating a generally negative pressure environment. First of all, secondary horizontal exhaust manifolds 44 and 46 are provided for each of the respective exhaust manifolds 36 and 38. In viewing FIG. 1, it must be borne in mind that this is a schematic illustration which does not accurately portray the geometric relationships between the various components. Thus, when the secondary exhaust manifolds 44 and 46 are described as being horizontal, these must be viewed from the perspective of the normal orientation of their respective exhaust manifolds 36 and 38. The horizontal exhaust manifold 44 is connected by short pieces of pipe 48, 50 and 52 to the pipes leading to the exhaust ports of the numbers 2, 4 and 6 cylinders of the engine. These cylinders, it will be recalled, are the gasoline burning cylinders in the right bank of the engine. In a similar fashion, the horizontal exhaust manifold 46 is connected by means of short pieces of pipe 54, 56 and 58 to the pipes of exhaust manifold 38 which are connected to the exhaust ports of the numbers 1, 3 and 7 cylinders. These cylinders are the gasoline burning cylinders of the left bank of the engine.

The horizontal exhaust manifold 44 is connected by means of a pipe 60 and a control valve 62 to a T fitting 68. The horizontal exhaust manifold 46 is also connected by a pipe 64 and a control valve 66 to this T fitting 68.

The T fitting 68 is connected by means of a pipe 70 to a X or cross fitting 72. Two arms of the cross fitting 72 are connected to supply fresh air to the exhaust gases collected by the horizontal exhaust manifolds 44 and 46. More specifically, an air filter 74, a check valve 76 and a control valve 78 are connected in series to one of the arms of the cross fitting 72, while an air filter 80, a check valve 82 and a control valve 84 are connected to another arm of the cross fitting 72. Obviously, a single series combination of an air filter, check valve and control valve could be used in place of the two illustrated. The only requirement is that provision be made for supplying a sufficient volume of fresh air to the exhaust gases to produce the proper fuel/air mixture for good combustion.

The cross fitting 72 is connected by means of a pipe 86 to a centrally located input port 88 in the isolated intake manifold for the designated exhaust buring cylinders numbers 5 and 8. The various control valves 62, 66, 78 and 84 provide means for controlling both the volume and ratio of the components in the fuel/air mixture supplied to the designated exhaust burning cylinders.

In addition to the horizontal secondary exhaust manifolds 44 and 46, the exhaust manifolds 36 and 38 are also provided with vertical accumulators 90 and 92, respectively. Again, it should be borne in mind that the schematic illustration of FIG. 1 does not accurately portray the true geometric relationships of these several components. It should be understood, however, that the accumulators 90 and 92 are positioned so that their longitudinal axes are oriented in a vertical direction and, preferably, the accumulators are both located above their respective exhaust manifolds 36 and 38. The accumulator 90 is connected to its lower end by means of pipe 94 to a central position on the exhaust manifold 36, whereas the accumulator 92 is connected at its lower end by means of a pipe 96 to a central location on the exhaust manifold 38. The upper end of accumulator 90 is connected by means of a pipe 100 into the isolated intake manifold adjacent to the intake port for the number 8 cylinder. In a similar manner, the upper end of accumulator 92 is connected by means of a pipe 102 into he isolated intake manifold adjacent to the intake port for the number 5 cylinder. Thus, the exhaust and air mixture supplied via pipe 86 to port 88 in the isolated intake exhaust manifold is supplemented by gases supplied via pipes 100 and 102. The purpose of the accumulators 90 and 92 is to absorb the pulsations of the exhaust gases from the respective exhaust manifolds 36 and 38 by providing for expansion of those gases within the volumes of the accumulators. In addition, the accumulators have the function of allowing the lighter exhaust gases to be drawn off for combustion in the designated exhaust burning cylinders while at the same time permitting the heavier exhaust gas products to be drawn off and exhausted to the atmosphere. This is beneficial because among the lightest exhaust gas products is hydrogen which is readily combustible while among the heavier exhaust gas products is carbon dioxide which is not combustible at all. To a lesser extent, the connections of the secondary horizontal exhaust manifolds 44 and 46 are also designed to draw off the lighter combustion products in the exhaust gases from the gasoline burning cylinders.

For purposes of providing proper pressures within the exhaust manifolds 36 and 38, certain additional modifications are made to these exhaust manifolds. In manifold 36, a balance pipe 104 is connected between the pipe leading to the exhaust port of cylinder number 8 and a position adjacent the outlet 40. This relieves the pressure adjacent to the exhaust port of cylinder number 8 which would ordinary exist because of the remote location of this exhaust port with respect to the outlet 40. In the embodiment illustrated, a similar pipe is not required for the exhaust manifold 38 since the exhaust port for cylinder number 5, the other designated exhaust burning cylinder, is reasonably proximate to the outlet 42 of the manifold. An air balance line 106 is also connected near the top of the accumulator 90 and to the balance pipe 104, and a similar air balance line 108 is connected near the top of the accumulator 92 and to a point on the exhaust manifold 38 below the connection thereto of pipe 96. Gases flow in either direction in the air balance lines 106 and 108 depending on the pressure differentials created at either end of these two balance lines. These balance lines, however, provide a passage for the heavier exhaust products to be ultimately vented to the atmosphere.

The exhaust manifold 36 and 38 are also provided with fresh air supply source. More specifically, exhaust manifold 36 is provided with the series combination of air filter 110, a check valve 112 and a connecting pipe 114 which communicates with the exhaust manifold 36 at a point relatively remote from the exhaust port of a designated exhaust burning cylinder number 8. The exhaust manifold 38 is also provided with a series combination of an air filter 116, a check valve 118 and a connecting pipe 120 which communicates with the manifold at a point which is relatively remote to the exhaust port for the designated exhaust burning cylinder 5.

The structure just described all contributes to establishing a negative pressure environment in the common exhaust manifold system when the exhaust burning cylinders are intaking. In addition, the exhausting pressure of the exhaust burning cylinders is relieved in the case of the number 8 cylinder by means of the pipe 104, and this helps to maintain a higher negative pressure manifiold. This negative pressure and environment of the common exhaust manifold system improves breathing of the engine by removing all of the exhaust gases from the gasoline burning cylinders during their respective exhaust stroke cycles.

The arrangement shown in FIG. 1 has the additional advantage of promoting a very lean fuel/air mixture in the gasoline burning cylinders by inducting fresh air through the check valves 112 and 118 during the valve over-lap period. More specifically, the pressure within a gasoline burning cylinder during an intake stroke cycle is negative. At the start of the intake stroke cycle, the exhaust valve is still open for a short period. As a result, fresh air will be drawn into the cylinder through the exhaust manifold causing the fuel/air mixture to become quite lean.

With respect to the designated exhaust burning cylinders, it is desirable to supply the fuel/air mixture to the isolated intake manifold with a minimum of heat loss so that the advantages of thermal expansion in the exhaust burning cylinders may be realized. To this end, the horizontal exhaust manifolds 44 and 46, the pipes 60, 64, 70 and 86, the vertical accumulators 90 and 92, and the pipes 94, 96, 100 and 102 are all preferably insulated. In addition, it may also be desirable to insulate the exhaust manifolds 36 and 38, the pipe 104 and the air balance lines 106 and 108. On the other hand, the temperatures of the gasoline burning cylinders are reduced by the improved breathing of the engine whereby the hot residual combustion products are quickly evacuated during the exhaust cycles. An additional factor in reducing the temperatures of the gasoline burning cylinders is the induction of fresh atmospheric air through the exhaust manifolds during the exhaust valve over-lap as previously discussed.

The present invention offers additional unique advantages. More particularly, with reference to FIG. 5, an improvement can be realized by venting the crankcase and gasoline supply tank into the isolated intake manifold for the designated exhaust burning cylinders. In FIG. 5, a right side view of a V8 engine is represented at 122. The right exhaust manifold 36 is shown, but the horizontal exhaust manifold 44 and vertical accumulator 90 have omitted from this figure for purposes of clarity. It will, of course, be understood that these structures are also present in an actual embodiment of this modification of the invention.

In the specific embodiment under discussion, fresh air is vented through the air filter 124, check valve 126 and short connecting pipe 128 through an opening in the rear of the valve compartment cover plate which normally serves as a road draft exit of crankcase vapors. The dotted arrows represent the circulation of crankcase vapors through the engine. These vapors flow out of the oil filler pipe 130 which is provided on the engine in stock condition. However, in place of the conventional breather cap normally provided on the oil filler pipe 130, a special fitting 132 having an outflow check valve 134 fitted thereto is provided. The fitting 132 makes a sealed connection to the oil filler pipe 130, but is adaptable for instant removal for oil replenishment.

The outflow check valve 134 is connected by means of pipe 136 to a heat exchanger 138. The heat exchanger 138 may be of any conventional design and may be mounted on the exhaust pipe 140 which is connected to the outlet 40 of the exhaust manifold 36. The purpose of the heat exchanger 138 is to heat the crankcase vapors passing through the outflow check valve 134.

The heated crankcase vapors from the output of the heat exchanger 138 are conducted by means of a pipe 142 to a T fitting 144. This T fitting 144 is connected by means of a variable position flow valve 146 to one end of the gasoline supply tank 148. The T fitting 144 is also connected by means of pipe 150 to a second T fitting 152. The T fitting 152 is connected by means of a second variable position flow valve 154 to another end of the gasoline supply tank 148 remote from the valve 146. The variable position valves 146 and 154 are used for adjusting the amount of vapors flowing into and out of the gasoline supply tank as required for smooth running of the engine. In addition, these valves 146 and 154 may be closed or adjusted to the off position for the purpose of isolating the gasoline supply tank from the rest of the system when so desired. The gasoline supply tank is provided with a filler pipe 156 as is conventional. The filler pipe 156 is provided with a non-vented filler cap 158.

The T fitting 152 is connected by means of pipe 160 through an outflow check valve 162 to the isolated intake manifold which is a part of the intake manifold 10. Preferably, the outflow check valve 162 is located proximate to the isolated intake manifold.

The venting system illustrated in FIG. 5 operates on a principle of a vacuum source being established in the isolated intake manifold by the intaking stroke of the exhaust burning cylinders. Atmospheric air enters the crankcase of the engine through the air filter 124, the check valve 126 and the connecting pipe 128. This air mixes with the crankcase vapors and circulates through the crankcase. This mixture of fresh air and crankcase vapors exit the crankcase through the oil filler pipe 30, the fitting 132 and the outflow check valve 134. The vapors are then heated in the heat exchanger 138 and thereafter are partially induced into the gasoline supply tank 148 through the adjustable valve 146. The heating of the vapors by the heat exchanger 132 prevents condensation of moisture from occuring in the gasoline supply tank 148. Some of the vapors from the heat exchanger 138 pass directly to the isolated intake manifold due to the direct connection of the pipe 150 between the T fittings 144 and 152. The vapors that do enter the gasoline supply tank 148 are mixed with the gasoline vapors and thereafter supplied to the isolated intake manifold.

It will be appreciated that the venting system described is completely closed to the atmosphere, and any pressure buildup will be relieved into the isolated intake manifold. It is possible to substitute for the non-vented filler cap 158 vented filler cap, but the vented filler cap should include a inflow check valve. Both vented and non-vented filler caps have their advantages. The non-vented type admits more crankcase vapors to the isolated intake manifold and the vented type resists the adiabatic process in the gasoline supply tank which could be caused by a very low pressure or high vacuum.

Those skilled in the art will recognize that the invention has been described with respect to a specific detailed embodiment including one improvement or modification thereof and that this description is merely illustrative of the invention. Obviously, different types of internal combustion engines having any desired number of cylinders could be modified and produced according to the principles of the invention. The specific embodiment described is therefore illustrative of the invention which is defined in the appended claims.

What is claimed is:

1. A method of modifying a multi-cylinder, gasoline burning internal combustion engine of the type employing times sparked ignition so as to achieve more complete combustion of the fuel supplied thereto and thereby improve the efficiency and economy of operation of the engine and at the same time reduce the levels of pollutants in the exhaust gases vented to the atmosphere, said method comprising the steps of:

a. selecting at least two cylinders to be the designated exhaust burning cylinders, said selected cylinders having their pistons at the same relative positions and traveling in the same relative directions during all cycles of the operation of the engine, b. modifying the intake manifold of the engine to isolate the designated exhaust burning cylinders from the remaining gasoline burning cylinders and thereby forming an isolated intake manifold for the designated exhaust burning cylinders, c. maintaining a common exhaust manifold system for both gasoline burning and designated exhaust burning cylinders, d. modifying said common exhaust manifold system by providing a secondary exhaust manifold for drawing off a portion of the exhaust gases from the gasoline burning cylinders and also providing an accumulator means for allowing expansion of the exhaust gases in the common exhaust manifold system to reduce the variations in pressure in the common exhaust manifold system, and e. supplying the isolated intake manifold with a controlled mixture of fresh air and the exhaust gases drawn off by the secondary exhaust manifold for burning in the designed exhaust burning cylinders.

2. The method according to claim 1 further comprising the step of maintaining the timed spark ignition of the engine in standard form and wherein the cylinders selected as the designated exhaust burning cylinders have their spark timing 360° apart.

3. The method of claim 1 further comprising the step of modifying the intake manifold of the engine to assure an even distribution of a fuel/air mixture to the gasoline burning cylinders.

4. The method of claim 1 further comprising the step of drawing off the lighter exhaust gases from the highest point of the accumulator means and supplying these lighter exhaust gases directly to the isolated intake manifold for burning in the designated exhaust burning cylinders.

5. The method of claim 1 further comprising the steps of maintaining a low pressure environment in the common exhaust manifold system and supplying fresh air to the low pressure environment in the common exhaust manifold system.

6. The method of claim 1 further comprising the step of venting the vapors generated in the crankcase of the engine and the vapors in the gasoline supply tank directly to the isolated intake manifold for burning in the designated exhaust burning cylinders.

7. The method of claim 1 further comprising the steps of a. drawing off the lighter exhaust gases from the highest point of the accumulator means and supplying these lighter exhaust gases directly to the isolated intake manifold for burning in the designated exhaust burning cylinders, b. maintaining a low pressure environment in the common exhaust manifold system and supplying fresh air to the low pressure environment of the common exhaust manifold system, and c. venting the vapors generated in the crankcase of the engine and the vapors in the gasoline supply tank directly to the isolated intake manifold for burning in said designated exhaust burning cylinders.

8. In a multi-cylinder, gasoline burning internal combustion engine of the type employing timed spark ignition, said engine including:

a. at least two cylinders selected to be designated exhaust burning cylinders, said selected cylinders having their pistons at the same relative positions and traveling in the same relative directions during all cycles of the operation of the engine, the remaining cylinders being gasoline burning cylinders, b. an isolated intake manifold to supply a combustible mixture to said designated exhaust burning cylinders, c. a common exhaust manifold system for both the gasoline burning and the designated exhaust burning cylinders, said common exhaust manifold system having a secondary exhaust manifold for drawing off a portion of the exhaust gases from the gasoline burning cylinders and also accumulator means for allowing expansion of the exhaust gases in the common exhaust manifold system to reduce the variations in pressure in the common exhaust manifold system, and d. means for supplying the isolated intake manifold with a controlled mixture of fresh air and the exhaust gases drawn off by the secondary exhaust manifold for burning in the designated exhaust burning cylinders, whereby a more complete combustion of the fuel supplied to said engine is achieved thereby improving the efficiency and economy of the operation of the engine and at the same time reducing the levels of pollutants in the exhaust gases vented to the atmosphere.

9. The internal combustion engine of claim 8 wherein the spark timing for the at least two designated exhaust burning cylinders is 360° apart.

10. The internal combustion engine of claim 8 further comprising means for drawing off the lighter exhaust gas products at the highest point on said accumulator means and supplying the lighter exhaust gas products directly to the isolated intake manifold.

11. The internal combustion engine of claim 8 further comprising means for supplying fresh air to said common exhaust manifold system, said means including a check valve for allowing the inflow of fresh air only.

12. The internal combustion engine of claim 8 further comprising means for maintaining a low pressure environment in said common exhaust manifold system.

13. The internal combustion engine of claim 8 further comprising a gasoline supply tank for supply fuel to the gasoline burning cylinders of said engine, and means for venting vapors generated in the crankcase of said engine and said gasoline supply tank directly to the isolated intake manifold for burning in the designated exhaust burning cylinders.

14. The internal combustion engine of claim 8 further comprising:

a. means for drawing off the lighter exhaust gas products at the highest point of said accumulator means and supplying the lighter exhaust gas products directly to said isolated intake manifold for burning in said designated exhaust burning cylinders, b. means for supplying fresh air to said common exhaust manifold systems, said means including a check valve for permitting the inflow of fresh air only, and c. means for maintaining a low pressure environment in said common exhaust manifold system.

* * * * *